US007618182B1

(12) United States Patent
Lott

(10) Patent No.: US 7,618,182 B1
(45) **Date of Patent: *Nov. 17, 2009**

(54) DUST-FREE LOW PRESSURE MIXING SYSTEM WITH JET RING ADAPTER

(75) Inventor: William Gerald Lott, Houston, TX (US)

(73) Assignee: Vortex Systems (International) LI, Grand Cayman (KY)

( * ) Notice: Subject to any disclaimer, the term of this patent is extended or adjusted under 35 U.S.C. 154(b) by 0 days.

This patent is subject to a terminal disclaimer.

(21) Appl. No.: 12/176,540

(22) Filed: Jul. 21, 2008

Related U.S. Application Data

(63) Continuation-in-part of application No. 11/737,690, filed on Apr. 19, 2007, now Pat. No. 7,401,973.

(51) Int. Cl.
*B01F 3/12* (2006.01)
*B01F 3/20* (2006.01)
*B01F 5/00* (2006.01)
*B01F 15/02* (2006.01)

(52) U.S. Cl. ..... 366/163.1; 366/165.1; 366/181.1; 366/177.1; 366/182.3

(58) Field of Classification Search ..... 366/163.2, 366/163.1, 165.1, 177.1, 173.1, 181.1, 181.5, 366/143
See application file for complete search history.

(56) References Cited

U.S. PATENT DOCUMENTS 2,396,290 A * 3/1946 Schwarz ..... 417/170
3,515,156 A * 6/1970 Schuh ..... 137/13
3,799,195 A * 3/1974 Hermans ..... 366/163.2
4,390,284 A * 6/1983 Hyde et al. ..... 366/165.5
4,487,553 A * 12/1984 Nagata ..... 417/171
5,020,858 A * 6/1991 Nishikawa ..... 299/8
5,132,025 A * 7/1992 Hays ..... 210/758
5,338,113 A * 8/1994 Fissenko ..... 366/181.5
5,382,411 A * 1/1995 Allen ..... 366/165.2
5,447,394 A * 9/1995 Shepard ..... 406/48
5,664,733 A * 9/1997 Lott ..... 239/429
5,743,637 A * 4/1998 Ogier ..... 366/163.2
5,908,040 A * 6/1999 Defraites, Jr. ..... 134/10
6,024,874 A * 2/2000 Lott ..... 210/512.1
6,076,955 A * 6/2000 Wallther ..... 366/163.2
6,164,380 A * 12/2000 Davis ..... 166/312
6,357,906 B1 * 3/2002 Baudoin et al. ..... 366/163.2
6,609,638 B1 * 8/2003 Lott ..... 222/564
6,796,704 B1 * 9/2004 Lott ..... 366/163.2
6,811,709 B2 * 11/2004 Arnaud ..... 366/165.1
6,811,713 B2 * 11/2004 Arnaud ..... 210/788
7,048,432 B2 * 5/2006 Phillippi et al. ..... 366/164.1
7,401,973 B1 * 7/2008 Lott ..... 366/163.2
2004/0141410 A1 * 7/2004 Fenton et al. ..... 366/163.2
2004/0190368 A1 * 9/2004 Allen ..... 366/152.1

(Continued)

*Primary Examiner*—Tony G Soohoo
(74) *Attorney, Agent, or Firm*—Buskop Law Group, PC; Wendy Buskop

(57) ABSTRACT

A dust-free mixing system for use with drilling fluids having a jet ring adapter. The dust-free mixing system can have an eductor. The eductor can have a housing with an axial bore for receiving a first suction induction port. The first suction induction port is for receiving a first dry component. The eductor can have a second suction induction port for receiving a second dry component. The eductor can further have a third suction induction port for receiving a third dry component.

12 Claims, 14 Drawing Sheets

U.S. PATENT DOCUMENTS

2005/0024988 A1* 2/2005 Hoff et al. ..... 366/163.2
2005/0058020 A1* 3/2005 Lott ..... 366/163.2
2005/0111298 A1* 5/2005 Lott ..... 366/163.2

* cited by examiner

DUST-FREE LOW PRESSURE MIXING SYSTEM WITH JET RING ADAPTER

CROSS REFERENCE TO RELATED APPLICATIONS

This application is a Continuation in Part Application of Co-pending U.S. patent application Ser. No. 11/737,690, filed on Apr. 19, 2007, the disclosure of which is incorporated herein by reference. Application Ser. No. 11/737,690 has issued as U.S. Pat. No. 7,401,973 on Jul. 22, 2008.

FIELD

The present embodiments relate to a closed, high-velocity mixing system for use with mixing drilling fluids.

BACKGROUND

The mixing of liquids with particulates requires a mixing system that provides a dust-free mixing system. The flow of the liquid during mixing should be turbulent to ensure that the particulates are sufficiently agitated to create a complete mixture of the particulates and the liquid.

Traditional mud mixing systems store barite or, in some cases, bentonite in a surge tank, which is stored over a chemical hopper also referred to as a "mud hopper". A valve is used to flow bentonite or barite out of a hose connected to the surge tank into the "mud hopper". Air born dust is created as the barite or bentonite flows into the "mud hopper." The air born dust is harmful to workers and to equipment. There exists a need for a mixing system that is dust-free and low pressure.

When flowing particulates from a storage unit to a mixing area the particulates often clog within the transportation conduit, which requires the transport conduit to be disassembled so that the bringing material can be removed. Therefore, there exists a need for a dust-free low pressure mixing system that prevents the particulate from clogging within the conduit.

The present embodiments meet these needs.

BRIEF DESCRIPTION OF THE DRAWINGS

The detailed description will be better understood in conjunction with the accompanying drawings as follows.

Figure 1A:
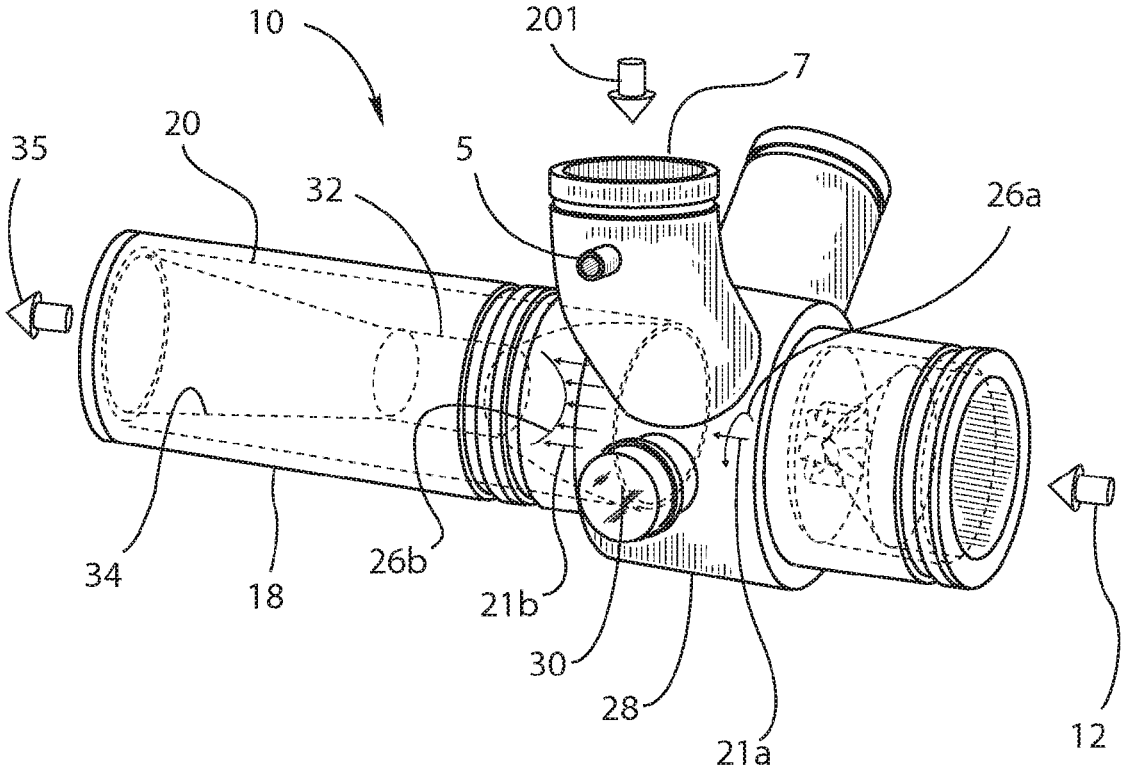
FIGS. 1*a* and 1*b* depict an embodiment of the eductor that is adapted for use with the dust-free mixing system.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate generally to a dust-free mixing system for use with drilling fluids. The dust-free mixing system can have an eductor. The eductor can have a housing with an axial bore for receiving a first suction induction port. The first suction induction port is for receiving a first dry component.

The axial bore can receive a second dry component through a second suction induction port. The axial bore can also have a third induction port for receiving a third dry component. The first dry component, second dry component, and third component can be mixed in a high-velocity low pressure mixing region with a pressurized liquid flowing through the axial bore, creating an eductor discharge, which is a uniformly mixed slurry. The eductor discharge is generally also referred to as a drilling fluid or a drilling mud, however, the eductor discharge does not have to be mud.

It is contemplated that the first suction induction port, second suction induction port, and third suction induction port can have a vacuum pressure creating a near perfect vacuum when the pressurized liquid is traveling at least 72 feet per second.

In an embodiment of the dust-free mixing system, a vacuum gauge can be in communication with the axial bore for indicating the vacuum within.

The eductor has a nozzle with a non-circular axisymmetrical lobe shaped orifice disposed within the axial bore. The pressurized fluid can enter the axial bore and flow through the nozzle. As the pressurized liquid exits the non-circular axisymmetrical lobe shaped orifice the pressurized liquid will have an axial flow path and a radial flow path. The low pressure-mixing region can be in communication with the nozzle.

On a side of the low-pressure mixing region opposite the nozzle can be a parabolic inlet, which can be in communication with the low pressure-mixing region. The parabolic inlet can be integrally connected to a cylindrical throat. The cylindrical throat can be integrally connected with a conical diffuser. As the eductor discharge traverses from the cylindrical throat to the conical diffuser a Venturi effect can be formed.

The eductor discharge leaves the conical diffuser with a pressure recovery of at least 50 percent of the initial pressure of the pressurized liquid. With embodiments of the eductor the pressure recovery can range from about 50 percent to about 80 percent of the original pressure of the pressurized liquid.

The embodiments of the eductor generally relate to a closed mixing system for mixing at least two separate components or constituents.

An eductor mixing system is effective in continuously mixing separate components such as liquids and particulate materials to form uniformed mixed slurry. The term "uniform mixed slurry" is interpreted herein as including granular materials, powdered materials, and other pressure soluble materials.

The eductor system thoroughly mixes the liquid with the particulate material and obtains a relatively high negative pressure or vacuum level, which is efficiently generated to positively draw or suck the particulate material into the eductor system.

The working pressurized liquid is directed through a nozzle to produce a high-velocity. The high-velocity liquid stream generates a low-pressure region adjacent the down stream end of the particulate material. The low-pressure zone causes the particulate material to be drawn or sucked through a suction port into a mixing region created by the swirling liquid stream adjacent the nozzle for the particulate material.

The eductor connects to the radial pre-mixer, which has swirl. Swirl is the circumferential velocity component that will cause a fluid stream to rotate about its axis. Swirl changes energy momentum into centrifugal force that will cause a rotating stream to have at least two velocity components: a) axial, and b) radial. The heavier or denser material (solids) or liquid to the outside while the radial velocity will move the lighter constituents to the inside toward the longitudinal axis. The introduction of swirl enhances mixing due in part to an increase in turbulence.

Swirl imparts radial acceleration to particles, modifying their motion and dispersion behavior, and enhances interfacial contact between two or more constituents due to stretching, straining and folding of particles and droplets to form a uniform mixture. The total energy in a steadily flowing fluid is constant along its flow path and as the velocity of the fluid increases the pressure within the fluid decreases. The intense swirling motion of the pressurized liquid when it enters the mixing region provides a sheet of liquid that has a uniform pressure profile.

When the liquid helical stream passes through a constriction, slower moving fluid adjacent the surfaces defining the constriction forms an energized boundary layer to reduce frictional drag or a shear layer resulting in a more efficient pressure recovery.

It should be noted that the eductor provides a passive method of energizing the fluid boundary layer in a conically shaped diffuser, providing a method to reduce viscous drag with a diffuser having a short throat, and providing a method that generates a vacuum with a nozzle fluid velocity of about 60 feet per second and an operating pressure drop of about 25 psig.

The dust-free low pressure mixing system can have a bulk storage tank in communication with the second suction induction port. The bulk storage tank has a body and the body has an inlet port. The bulk storage tank also has a discharge segment connected to the body. The discharge segment can be conical or dish shaped. The silo has a vent, which is opened when the silo is being emptied or filled.

A flow promoter, such as a V-Slide® manufactured by Vortex Ventures. Inc., of Houston, Tex., can be connected to the discharge segment. The flow promoter has the benefit of allowing the first dry component to flow more efficiently from the bulk storage tank to the eductor. The flow promoter reduces stress at the discharge port.

The flow promoter can have a flow promoter body. The flow promoter body can have a cavity core, an inlet end, an outlet end, and a central axis.

The cavity core can extend from the inlet end to the outlet end. The cavity core can define an outlet orifice at the outlet end. The inlet end can have an inlet orifice and an inlet face. The inlet orifice can be defined by the cavity core and a plurality of lobes. The inlet orifice can have a plurality of inlet ridges located between the plurality of lobes. A plurality of inlet slopes can be recessed into a flange.

In an embodiment of the dust-free low pressure mixing system, a connecting conduit with a clear segment can be disposed between the flow promoter and the eductor. The segment with a sight-glass can be used for viewing the flow of the second dry component.

In the present embodiment of the dust-free low pressure mixing system, the radial pre-mixer can be in fluid communication with a first suction induction port. The radial pre-mixer is disposed between the first dry component source and the eductor for generating a vortex to pre-wet and hydrate the first dry component.

A diverter manifold can be used for flowing pressurized fluid from the eductor to the radial pre-mixer. The radial pre-mixer is beneficial when the first dry component is a chemical, such as a polymer, because it allows for polymer dissolution without "fish eyes". "Fish eyes" are when portions of the dry component are not completely hydrated.

The first dry component source can be a hopper equipped to receive bags containing chemicals. The hopper can have a bag slitter and a conveyor table. In an alternative embodiment of the hopper, the hopper can be equipped with just a bag slitter or table it is not necessary that the hopper have both the table and the bag slitter.

The hopper can also have a bag slitter insert disposed within a bowl shaped interior cavity of the hopper. The bag slitter can have a substantially hollow central cavity in fluid communication with the eductor. The hollow central cavity allows the first separate component to be feed to the eductor in a substantially dust-free manner. The first separate component is able to be feed in a substantially dust-free manner due to the bag, containing the first dry component, conforming to the shape of the bowl shaped interior cavity, creating a soft seal between the interior cavity of the hopper and the bag.

It is contemplated that in an embodiment of the dust-free low pressure mixing system a first flow valve, such as a butterfly valve, can be disposed between the hopper and the pre-mixer and a second flow valve can be disposed between the secondary suction of the eductor and the flow promoter. The first and second flow valves can be adjusted to allow the first and second dry components to flow to the eductor simultaneously.

A third flow valve can be disposed between the mixing chamber and an outside supply in fluid communication with the third suction induction port. The third flow valve can be used to control the flow of fluids to the eductor through the third suction induction port. The liquids can be liquid chemicals, such as caustic soda, emulsifiers, and substantially similar chemicals.

A cyclone separator can be attached to the silo proximate to the vent. The cyclone separator can be in communication with the third suction induction port of the eductor. The dust recovered by the cyclone separator can be the whole third dry component.

The cyclone separator can include an outer housing. A discharge nozzle can define a circular central region, having a laterally extending entrance opening with a cone shape. The cone shape chamber can have a vortex finder suspended from an upper inner housing and extending cone shape chamber for a substantial distance. The cyclone separator can also have a stabilizer. The vortex finder includes a fluted inlet and an outlet for clean air discharge.

A fluidizer can be disposed between the flow promoter and the second suction induction port. The fluidizer can have a concentric reducer. The concentric reducer can have an air supply port. The air supply port can receive pressurized air. The concentric reducer can have an interior concentric cavity for receiving a flexible fluidizer insert. The flexible fluidizer insert has a groove formed into the outer surface. The groove is at an elevated position relative to the air supply port. The flexible fluidizer insert can be made out of Urethane, rubber, various other flexible polymers, or another flexible material. The fluidizer housing can be Urethane, carbon steel, urethane pipe, or stainless steel.

The pressurized air flows to the groove and causes the flexible fluidizer insert to vibrate and flutter. As the flexible fluidizer vibrates and "flutters" a sheet of air is created to fluidize the second dry component and unclog any bridging material by increasing fluidity of the powder. The fluidization of the second dry component causes the second dry component to flow like a fluid. This fluid flow prevents clogs in the system as the second dry component traverses from the silo to the eductor. The fluidizer can be selectively activated to brake up clogs as they form due to clumping of the second dry component.

In an embodiment of the dust-free low pressure system, the eductor, silo, flow promoter, connecting conduit, radial premixer, diverter manifold, cyclone separator, and fluidizer can be integrally connected closed system. Allowing the system to mix and disperse a uniformly blended mixture, in a dust-free manner. The embodiments of the invention can be better understood with reference to the figures.

Figure 1B:
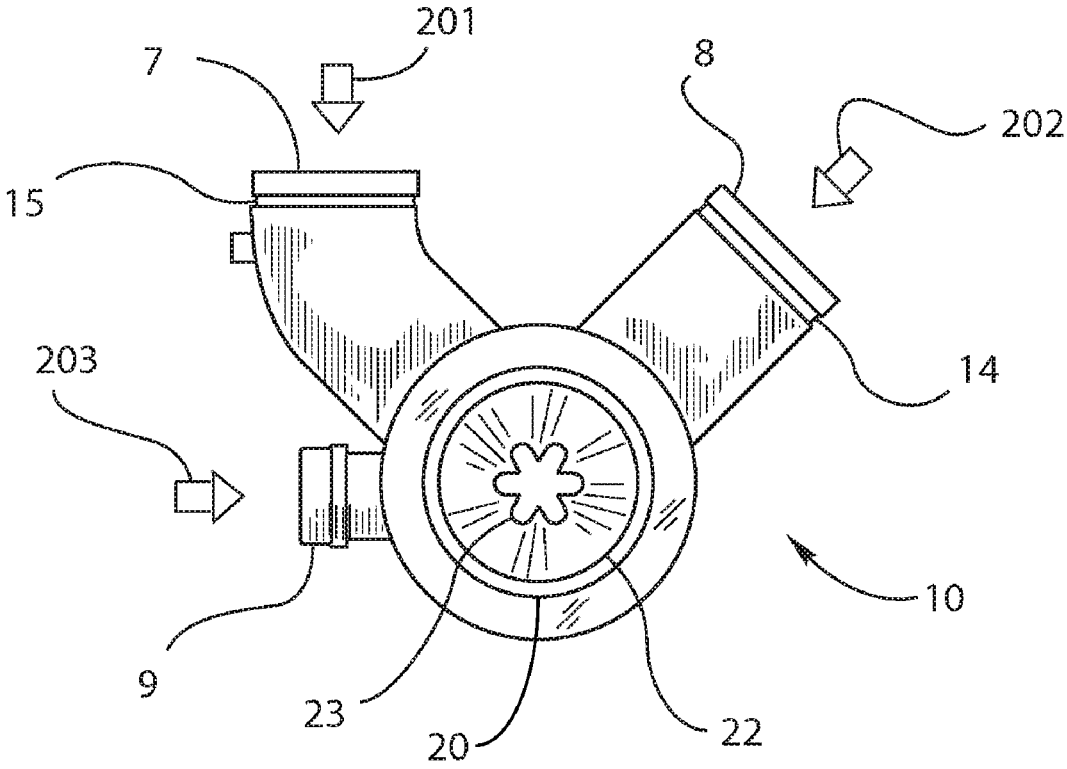

Referring now to FIGS. 1*a* and 1*b*, an embodiment of the eductor 10 is depicted. The eductor 10 is depicted having a housing 18. The housing 18 has an axial bore 20. The housing 18 has a first suction induction port 7, a second suction induction port 8, and a third suction induction 9 in fluid communication with the axial bore 20 proximate to a high-velocity low-pressure mixing region 28.

The first suction induction port 7 can be in fluid communication with a first dry component supply, such as a hopper. The first dry component 201 can be a chemical such as polymers, clays, starches, barite, and other similar mud additives.

The second suction induction port 8 can be in fluid communication with a silo containing a second dry component 202. The second dry component 202 can be Barite or Bentonite, or another similar bulk material used in the manufacture of drilling mud.

The second dry component 202, for example, can be pneumatically transferred from a large storage apparatus on the drilling rig to a bulk storage tank. For example, a tubular can be connected to an inlet port. The inlet port can be a threaded 6 inch inside diameter cavity located on the body of a silo or a similar cavity capable of securely and removably receiving a tubular.

The first suction induction port 7, is depicted having a pressure gauge 5, for measuring the vacuum acting upon the second suction induction port 8. A similar pressure gauge can be attached to each of the suction induction ports.

The first suction induction port 7 and the second suction induction port 8 can have a first clamp groove 15 and a second clamp groove 14 for allowing a tubular to be independently and securely clamped to each of the suction induction ports. The conduit that can be connected to each of the suction induction ports creates a sealed system.

The first suction induction port 7, second suction induction port 8, and third suction induction port 9 have suction due to the eductors utilization of Kinetic energy to create the high-velocity low-pressure mixing region.

The pressurized liquid 12, such as water, enters the axial bore 20 and traverses through a nozzle 22, such as a Lobestar® jet nozzle, model number V-VE-U-6A, manufactured by Vortex Ventures, Inc., of Houston Tex., exiting the non-circular axisymmetrical lobe shaped orifice 23. As the pressurized fluid exits the axisymmertical lobe shaped orifice 23, the pressurized fluids velocity is increased, by the converging shape of the nozzle, and the pressure is decreased.

The non-circular axisymmetrical lobe shaped orifice 23 forces the pressurized liquid to flow in a radial flow path 26*a* and an axial flow path 21*a*. When the pressurized liquid 12 enters the high-velocity low-pressure mixing region 28 the pressurized liquid 12 has a turbulent flow, which enhances the mixing of the first dry component 201, second dry component 202, and third component 203.

The pressurized liquid 12, the first dry component 201, the second dry component 202, and the third component 203 are mixed in the high-velocity, low-pressure mixing region 28, forming eductor discharge 35 which is a uniform mixed slurry.

The eductor discharge 35 exits the high-velocity low-pressure mixing region 28 with the axial flow path 21*b* and radial flow path 26*b* into a parabolic inlet 30, which is in communication with the high-velocity low-pressure mixing region 28, and integrally connected to a cylindrical throat 32.

The eductor discharge 35 traverses through the cylindrical throat 32 to a conical diffuser 34, which is integrally connected to the cylindrical throat 32. During this transition a Venturi effect is created.

In the current embodiment of dust-free low pressure mixing system the pressure recovery within the conical diffuser is enhanced because the radial flow path 26 reduces the frictional drag and delays separation.

When the eductor discharges, which can be a uniform mixed slurry, exits the conical diffuser 34, the eductor discharge can have a pressure recovery of at least about 50 percent of the pressurized liquid 12 relative to when the pressurized liquid entered the axial bore. The pressure recovery can range between about 50 percent to about 80 percent of the pressure of the pressurized liquid upon entering the axial bore.

The eductor as described is capable of mixing tonnage of Barite per minute, which ranges between at least about 2 metric tons per minute and up to about 3 metric tons per minute. This allows for faster drilling times and reduces the costs associated with man-hours, thereby making drilling operations more profitable.

Figure 2:
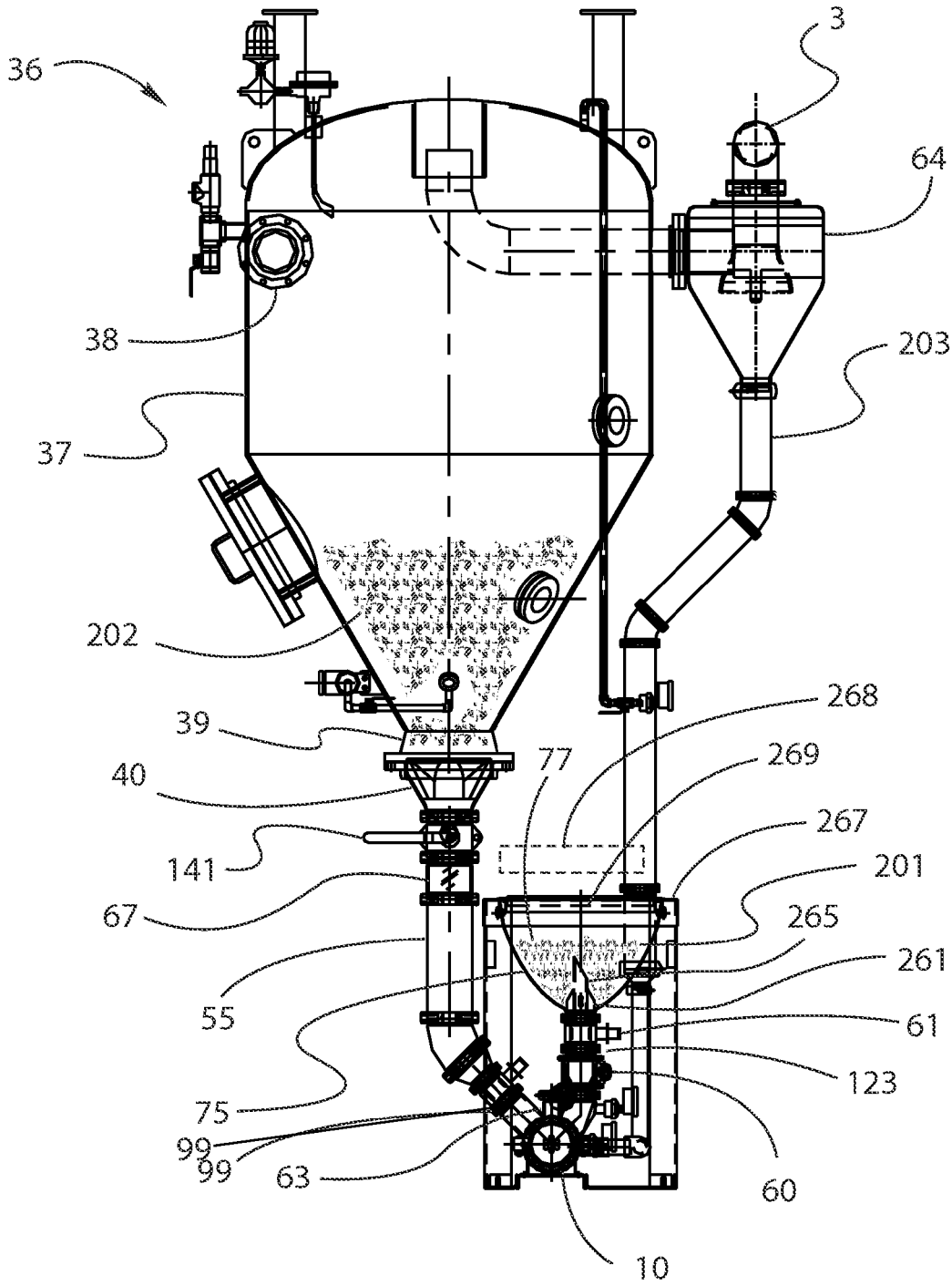
FIG. 2 depicts a schematic of the dust-free mixing system.

FIG. 2 depicts a schematic of the dust-free low pressure mixing system 1. The dust-free low pressure mixing system 1 is depicted having a silo 36. The silo 36 can have a capacity of at least 75 cubic feet, a net weight of at least 4,744 pound, and a height of at least 132.15 feet.

It is contemplated that other common containment means can be used. The silo 36 has a body 37. The body 37 can be made out of steel, aluminum, or other similar materials. The body has an inlet port 38, for receiving bulk material, for example the inlet port 38 can receive bulk material using a pneumatic system connected to a bulk storage container.

The body 37 is connected to a discharge segment 39. The discharge segment 39 can be conical or dish shaped. The silo 36 has a vent 3, located proximate to the top of the body 37. The vent 3 can be a cavity formed into the body 37, with a connection port coming there from. The vent 3 can be screened or unscreened. The inner diameter of vent 3 can range from about 3 inches to about 40 inches.

The discharge segment 39 is secured to flow promoter 40, a flow promoter 40 can be a V-Slide® manufactured by Vortex Ventures, Inc., from Houston, Tex. The flow promoter 40 promotes "mass flow" from the silo 36. The flow promoter 40 prevents powder bridging, also called stationary mass. Therefore, the flow promoter 40 reduces the circular stress at the discharge segment 39. The flow promoter is the type described in U.S. Pat. No. 6,609,638, which is incorporated herein in the entirety.

Figure 3:
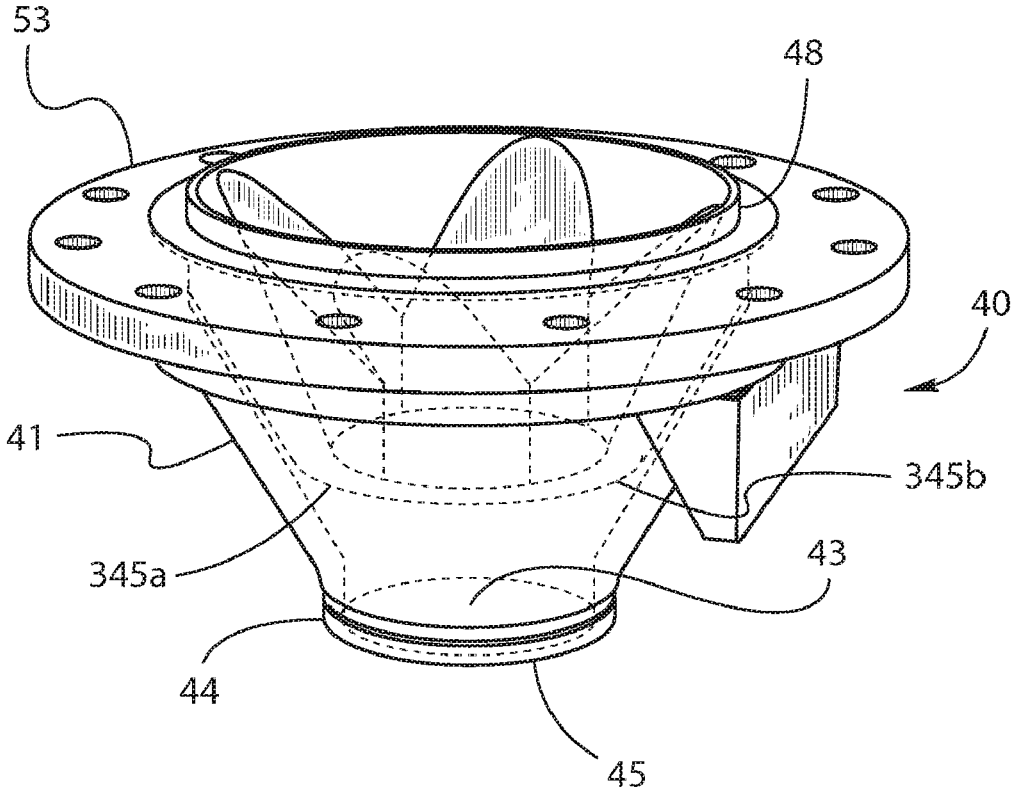
FIG. 3 depicts a plan view and elevated view of an embodiment of the flow promoter adapted for use with the dust-free mixing system.
Figure 4:
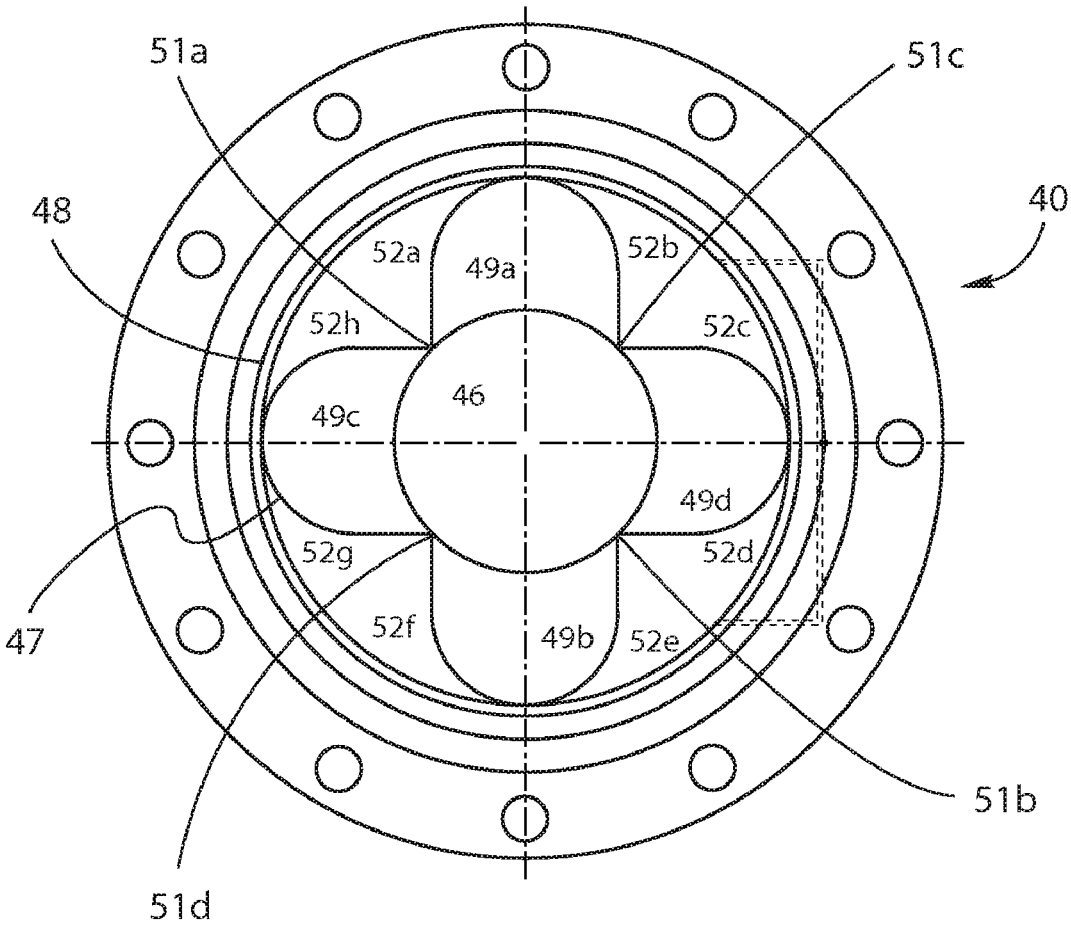
FIG. 4 depicts a top view of a flow promoter.

The flow promoter 40 can be better understood by referring to FIG. 3 and FIG. 4, which depict an embodiment of the flow promoter 40. The flow promoter 40 is depicted with a flow promoter body 41. The flow promoter body is depicted having a cavity core 42, an inlet end 43, an outlet end 44, and a central axis 45.

The cavity core 42 extends from the inlet end 43 to the outlet end 44, the cavity core 42 defines an outlet orifice 46 at the outlet end 44. The cavity core 42 is oriented parallel with the directional force of the second component contained in the flow promoter 40.

The inlet end 43 has an inlet orifice 47 and an inlet face 48. The cavity core has a plurality of lobes 49*a*, 49*b*, 49*c*, 49*d* defining the inlet orifice 47. Between the plurality of lobes 49*a*-49*d* are a plurality of inlet ridges 51*a*, 51*b*, 51*c* and 51*d* a plurality of inlet slopes 52*a*, 52*b*, 52*c*, 52*d*, 52*e*, 52*f*, and 52*h* recessed into a flange 53.

The second dry component 202 enters cavity core 42 through inlet orifice 47. If the flow rate is light, the second dry component 202 immediately hits the surfaces of cavity core 42 and continues down to outlet end 44 and out outlet orifice 46.

When the flow through the flow promoter 40 is constrained the particles of the second dry component 202 rest against each other, the plurality of lobes 49*a*-49*d*, the inlet slopes 52*a*-52*h*, and the inlet ridges 51*a*-51*d*. As particles of material at outlet orifice 46 exit cavity core 42, the second dry component 202 directly surrounding the exiting particles move into their place.

The lobe cavity wall angle 43 is sufficiently steep and smooth to facilitate the movement of the second dry component 202 along lobe cavity walls 45 to outlet orifice 46. The shape of cavity core 42, does not provide sufficient support for the particles to form arches, which would stop the flow of the second dry component 202.

The required angle of steepness of lobe cavity walls 345*a* and 345*b* is affected by the required release angle, and critical arching diameter of the second component.

Unlike a standard conical bin, the flow promoter 40 can be constructed with a lobe cavity wall angle 43 of less than the required release angle, and the outlet orifice 46 of less than the critical arching diameter of the second component. The decrease in the lobe cavity wall angle 43 can be in the range of up to about 20 degrees, and the decrease in the outlet orifice 46 can be more than about 0.5 the critical arching diameter, while still maintaining uniform first-in/first-out mass flow. A greater wall angle 43, inlet slopes 52*a*-52*h*, and inlet ridges 51*a*-51*d* provide a greater aspect ratio of inlet orifice 46 diameter to cavity height 47.

Returning to FIG. 2, a valve 141, such as a butterfly valve, is depicted connected to the flow promoter 40. The valve 141 controls the flow of the second dry component 202 out of the flow promoter 40. The valve 141 is connected to a flow promoter connecting conduit 55 having a sight glass 57 disposed between the flow promoter 40 and the eductor 10 for viewing the flow of the second dry component 202. This is an important feature because the clear segment allows for identification of flow problems.

When there are flow problems a fluidizer 67 can be activated. The fluidizer 67 is depicted disposed between the flow promoter and the second suction induction port 8. The fluidizer 67 can be located between the connecting conduit 55 and second induction port 8, however, the only requirement for the location of the fluidizer 67 is that the fluidizer 67 is positioned between the flow promoter 40 and the second suction induction port 8.

Figure 5:
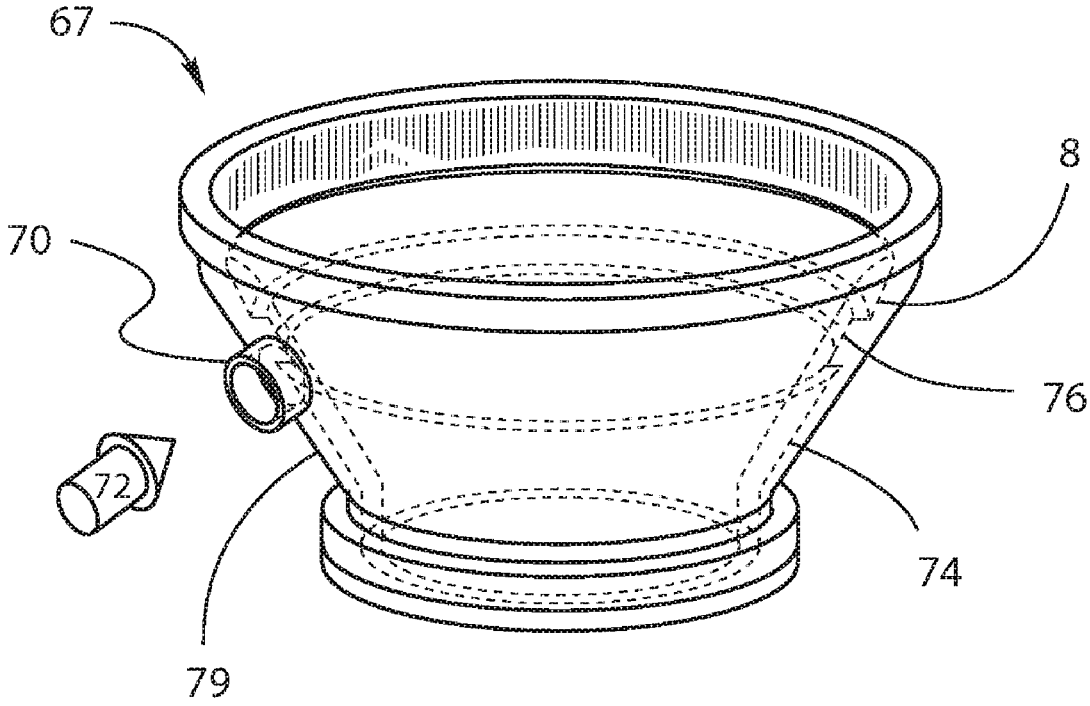
FIG. 5 depicts an embodiment of the fluidizer adapted for use with the dust-free mixing system.

The fluidizer 67 can be better understood with reference to FIG. 5, which depicts an embodiment of the fluidizer 67. The fluidizer 67 is depicted having a concentric reducer 79. The concentric reducer 79 should be relatively ridged and can be made from steel, urethane, composites, or other similar materials.

The concentric reducer 79 has an air supply port 70, such as a half coupling, for receiving pressurized air 72. For example the pressurized air 72 can be supplied from a compressor connected to the air supply port 70.

The concentric reducer 79 further has an interior concentric cavity 74. A groove 76 is formed into the outer surface 78 of a flexible fluidizer insert 80. The flexible fluidizer insert 80 can be made out of urethane. The groove 76 is at an elevated position relative to the air supply port 70, when the flexible fluidizer insert is slidably disposed within the interior concentric cavity 74.

The pressurized air flows to the groove 76 and causes the flexible fluidizer insert 80 to vibrate and flutter, causing a sheet of air to fluidize the second dry component causing the second dry component to act like a fluid preventing clogs from dry component clumping.

Returning now to FIG. 2, a jet-ring adapter assembly 99 is disposed between the diverter manifold 63 and the fluidizer 67.

The jet-ring adapter assembly 99 can be used to clean the present mixer, such as when large amounts of bentoninte and clay-based products have been mixed, through use of a high velocity jet downstream and a low pressure upstream.

A butterfly valve can be opened and closed to control pressure. For example, when the butterfly valve is open a high pressure created downstream of the jet-ring adapter, which generates a low pressure upstream. The high velocity/low pressure action purges the internals of the mixer. The jet ring adapter assembly 99 can be better understood with reference to FIG. 13.

Figure 13:
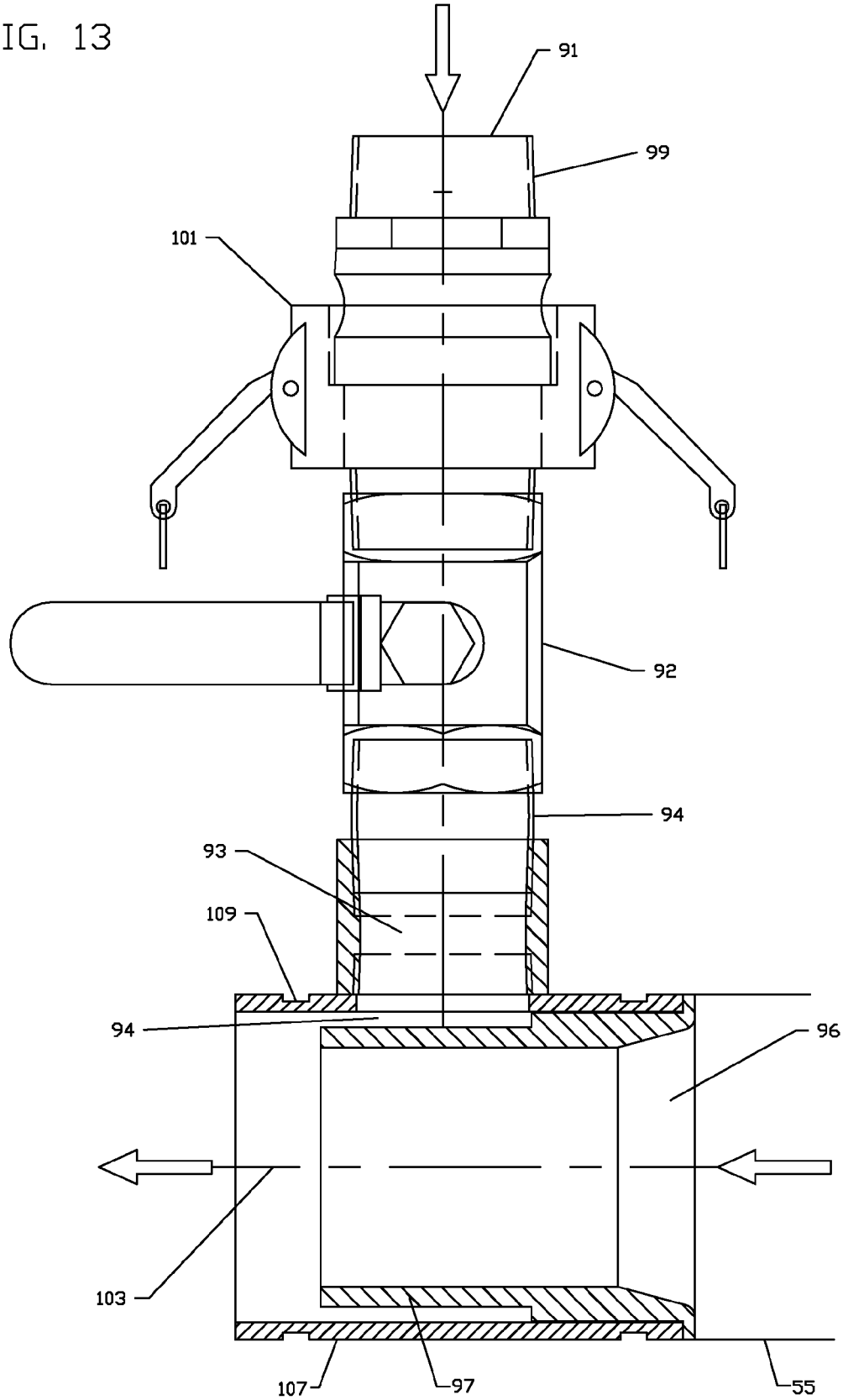
FIG. 13 is a schematic view of a jet-ring adapter.

FIG. 13 depicts the jet ring adapter 99 through which fluid and materials can flow. An exemplary jet ring adapter can include part VV-JRA-4-M1 made by Vortex Ventures, Inc., of Houston, Tex., having an outer diameter of about 4.5 inches.

The jet ring adapter body 107 with a grove connection 109 has an inlet 93 which receives motive fluid from a motive fluid inlet 91 for receiving pressurized fluid from a pressurized fluid source.

A ball valve 92 is depicted between the motive fluid inlet 91 and an inlet 93 to the jet ring adapter body 107.

An annular space 94 is within the jet ring adapter body 107 for receiving fluid and materials from the inlet 93. An annular nozzle 97 is disposed in one end of the annular space 94 for increasing the velocity of the fluid from the inlet 93 downstream while creating a corresponding low pressure region 96. The high velocity stream 103 is also depicted.

The annular nozzle can have different sizes, such as a inner diameter of about 4 inches with a motive feed to the nozzle of about 2 inches. The ball valve can be a 2 inch ball valve.

A camlock 101 is also depicted in FIG. 13. The camlock can be a threaded connection, a groove connection, or a flange connection.

Returning now to FIG. 2, cyclone separator 64 is connected to the silo 36 proximate to and in fluid communication with vent 3. The cyclone separator can be a Spintop Cyclone®, manufactured by Vortex Ventures, Inc., of Houston, Tex. The operation of a cyclone separator is defined in U.S. Pat. No. 6,024,874, which is incorporated herein by reference.

Figure 6:
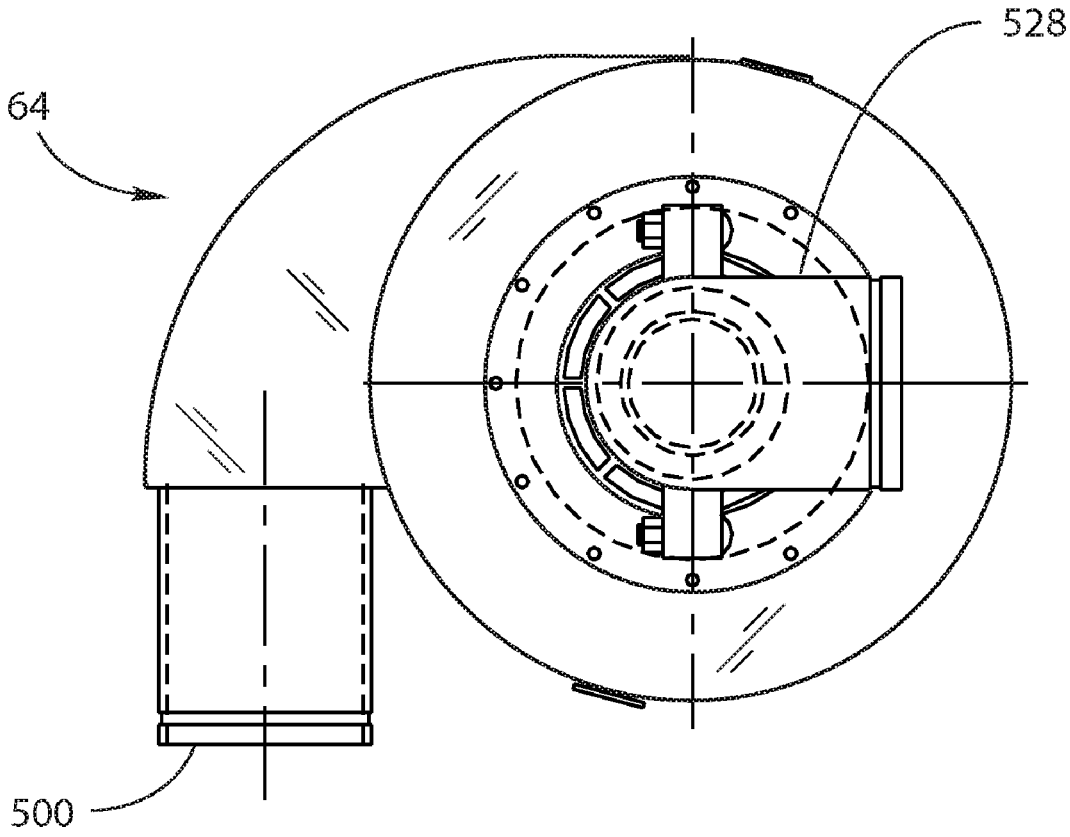
FIG. 6 depicts a top view of an embodiment of the cyclone separator adapted for use with the dust-free mixing system.
Figure 7:
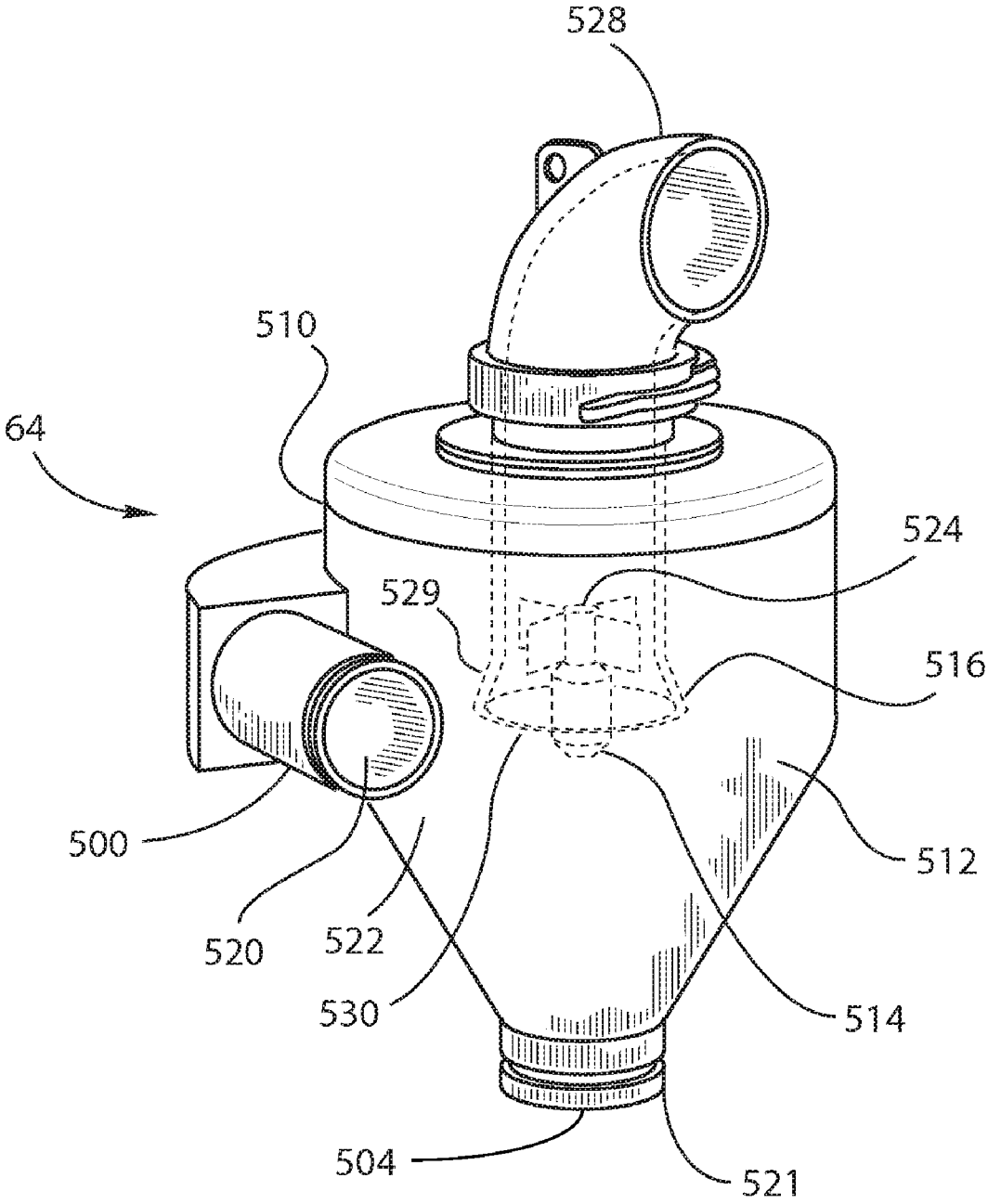
FIG. 7 depicts a side view of an embodiment of the cyclone separator adapted for use with the dust-free mixing system

The cyclone separator 64 can be better understood with reference to FIG. 6 and FIG. 7, which depict an embodiment of the cyclone separator. The cyclone separator 64 is depicted having an outer-housing 510 depicted having a cone shape chamber 522. The outer-housing 510 has a laterally extending entrance opening 500, for receiving air-containing dust from the vent 3. The cyclone separator centrifugally separates dust solids from expanding air within the silo 36, due to pneumatic filling of the silo 36.

The entrance opening 500 feeds air to a volute entrance 520 to the cone shaped chamber 522. The air stream entering the cone shaped chamber 522 is directed into a downwardly extending helical path by the inner surface of the cone shape chamber 522.

A vortex finder 524 is suspended from an upper inner housing 512 and extending to the cone shape chamber 522 for a substantial distance. A stabilizer 514 is secured to the bottom of the vortex finder 524. The vortex finder 524 comprises a fluted inlet 516. The vortex finder tube 524 has a lower flared bell-shaped portion 529, which flares or tapers outwardly and defines a lower entrance orifice 530 to the fluted inlet 516.

The outer-housing 510 has a discharge apex 521, which is positioned near the bottom of the cyclone separator 64 defining a circular central region 504 for fluid communication with the suction induction port 9, allowing the collected dust to be transported to the eductor 10 for mixing.

The cyclone separator 64 prevents dust from escaping through the vent 3. The cyclone separator exhausts clean air into the environment by an overflow outlet 528 in fluid communication with the fluted inlet 516, while simultaneously recycling the dust and converting into a reusable product.

Returning to FIG. 2, a hopper 75 is depicted with a bowl shaped inner cavity 77. The bowl shaped inner cavity 77 has a bag slitter 265 secured to the center of the bowl shaped inner cavity 77. The bag slitter 265 can be made out of steel, stainless steel, or another substantially hard material. The bag slitter 265 is depicted having a substantial hollow inner cavity 261 in fluid communication with the eductor 10. The hopper 75 is also depicted in this embodiment with a table 267, which has rollers 269.

The table 267 and rollers 269 allow for easy transportation of bags 268 to the bowl shaped inner cavity 77. Although, the hopper is depicted with a bowl shaped inner cavity 77, the hopper 75 can have an inner cavity 77 with different shapes, such as elliptical, cylindrical, rectangular, parabolic, or conical.

A second valve 61 is depicted disposed between the hopper 75 and a radial pre-mixer 60. A conduit 123 connects the second valve 61 to the radial pre-mixer 60. The second valve 61 can be a butterfly valve. The second valve 61 can be adjusted along with the first valve 141 to allow for simultaneous flow of first and second component.

The radial pre-mixer 60, such as s Vortex Radial Pre-mixer Model V V-PMB-4-UT, manufactured by Vortex Ventures, Inc., of Houston, Tex. and described in U.S. Pat. No. 6,796,704 which is incorporated by reference herein, is an annular jet pump device used in mixing applications to ensure complete mixing of liquids and hard to mix chemicals, such as polymers.

The radial pre-mixer is disposed between the first induction suction port 7 and a first dry component source, which in this embodiment is the hopper 75.

The radial pre-mixer 60 is used to generate a vortex to pre-wet disperse and hydrate the first dry component. A diverter manifold 62 is in fluid communication with the eductor 10 and the radial pre-mixer 60, for flowing a portion of the pressurized liquid 12 from the eductor 10 to the radial pre-mixer 60.

The diverter manifold 63 can be a tubular with a substantially circular cross section, the inner-diameter of the diverter manifold 63 can be between about 1/15 of an inch to about 35 inches. A valve can be disposed on the diverter manifold 62 for restricting the flow of pressurized liquid 12 through the inner-diameter of the diverter manifold 63. The radial pre-mixer 60 provides the benefit of allowing the eductor to create eductor discharge 35 without lumps, "fish eyes", and micro-gels.

The radial pre-mixer 60 can be best understood with reference to FIGS. 8-12, which depict an embodiment of the radial pre-mixer 60. The embodiment of the radial pre-mixer 60 is depicted including a generally cylindrical main body or housing 828. The cylindrical main body or housing 828 defines a generally cylindrical inner surface 830. A main body 828 has a central bore defined by inner peripheral surface 830, with an upper and lower portion 832 and 834 fastened together with a fastener 833. The fastener can be a compression fastener.

Figure 11:
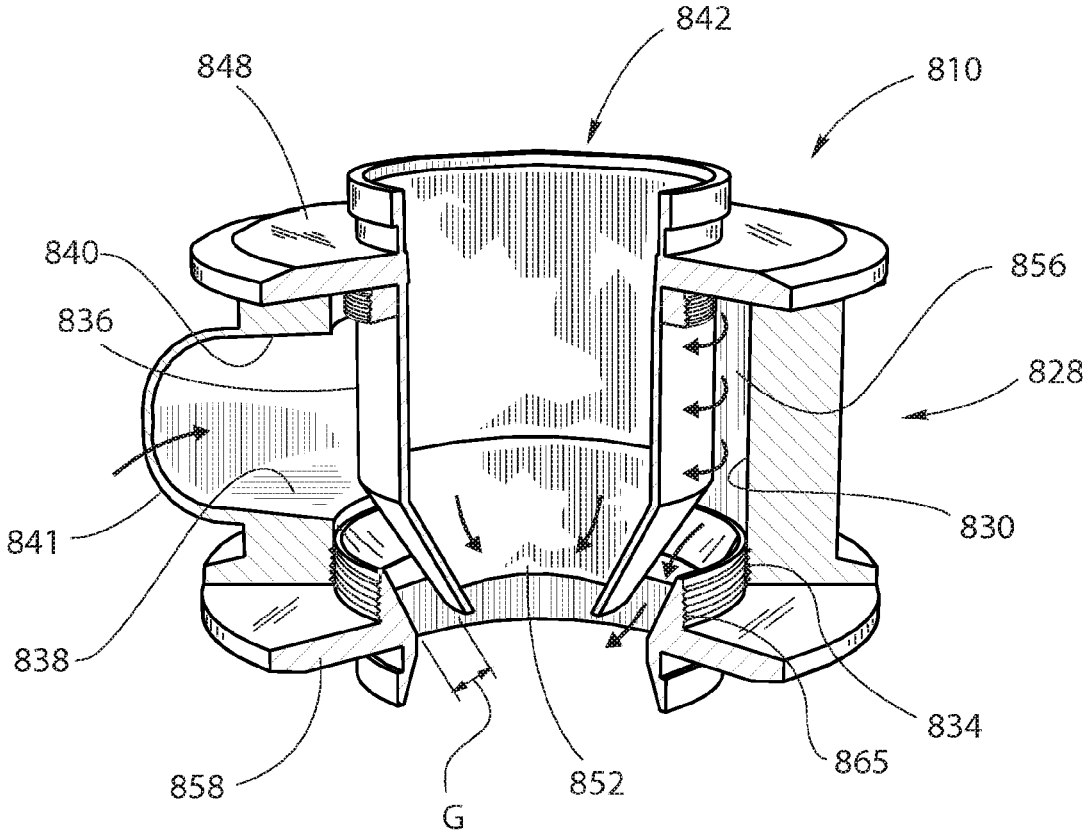
FIG. 11 is a perspective of the radial pre-mixer with certain parts broken away.
Figure 12:
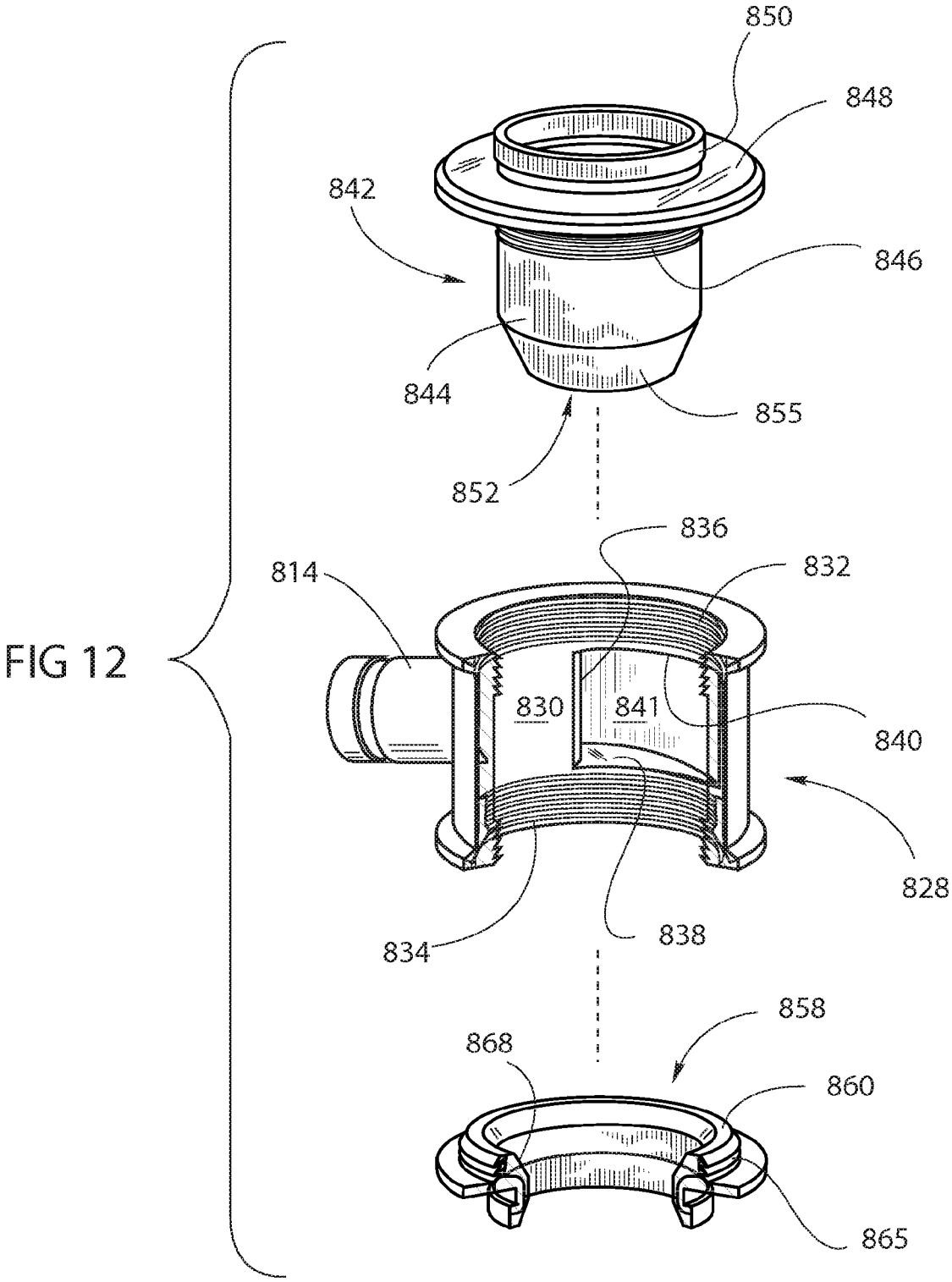
FIG. 12 is an exploded view of the radial pre-mixer depicted in FIG. 11.

As shown particularly in FIG. 11, an entrance opening 836 of a rectangular cross section for a liquid is formed between a lower planar ledge 838 and a similar upper planar ledge 840 to form an arcuate surface 841 there between which tapers and merges with peripheral surface 830. Cylindrical peripheral surface 830 forms a smooth continuation of arcuate surface 841. The diverter manifold 63 is of a circular cross section and a transition section for housing 828 is provided between the circular cross section and the rectangular entrance opening 836 between ledges 838 and 840. Thus, turbulence of the liquid entering body 828 is minimized.

An inner tube is shown generally at 842 to receive the particulate material from hopper 75. Tube 842 has a body 844 and an outer peripheral flange 848. Tube 842 is secured to the main body 830, with fastener 833, and flange 848 fits against the upper end of body 828 in sealing relation.

In this embodiment, the conduit 123 extends between hopper 75 and upper annular rim 850 of inlet tube 842. Inner tube 842 has a lower radial inner nozzle 852 having a smooth outer frusto-conical converging surface 855 to define a lower opening. Since frusto-conical surface 855 is smooth, turbulence of the swirling liquid is minimized. Outer peripheral surface 855 extends at an angle "A" of about 30 degrees as shown in FIG. 13 relative to the longitudinal axis of inner tube 842. Angle "A" can be between about 10 degrees to about 45 degrees and obtain satisfactory results under various conditions.

A vortex chamber is formed in main body 828 and annulus 856 extends between main body 828 and inner tube 842. Pressurized liquid entering body 828 from entrance opening 836 along arcuate surface 841 descends in a swirling helical path about inner tube 842 in annulus 856.

Figure 8:
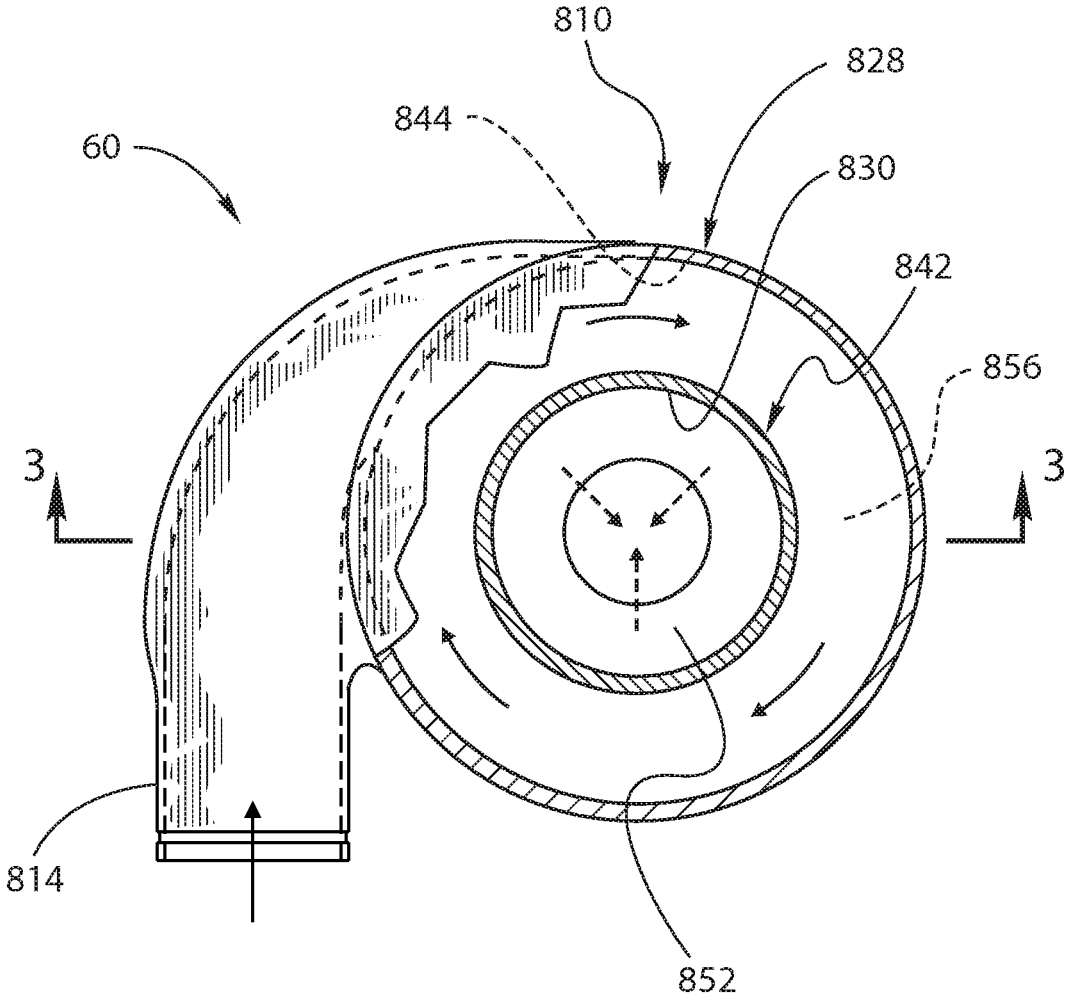
FIG. 8 depicts a top view of an embodiment of the radial pre-mixer usable with the dust-free mixing system.
Figure 9:
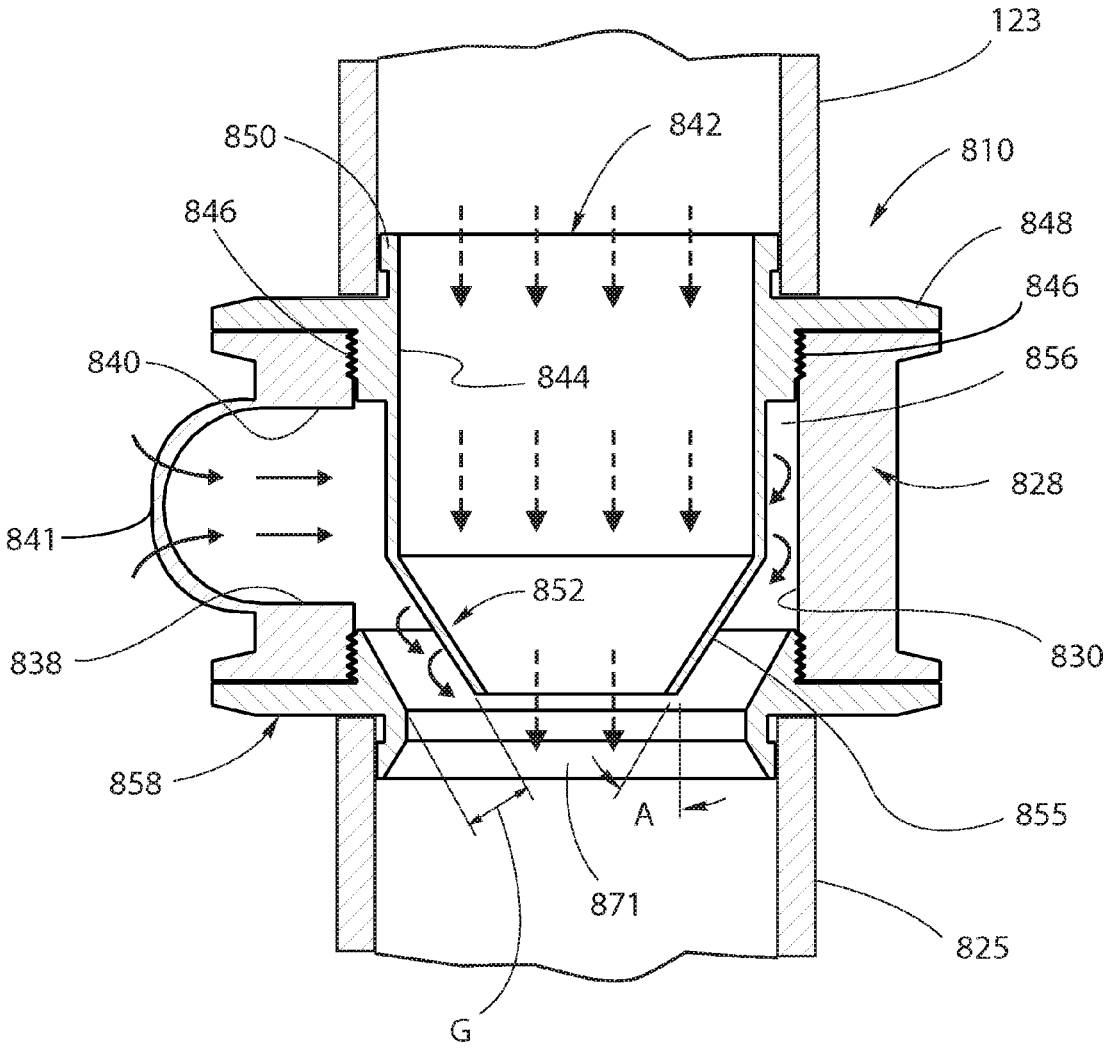
FIG. 9 depicts a section of the radial pre-mixer taken generally along line 3-3 of FIG. 2.
Figure 10:
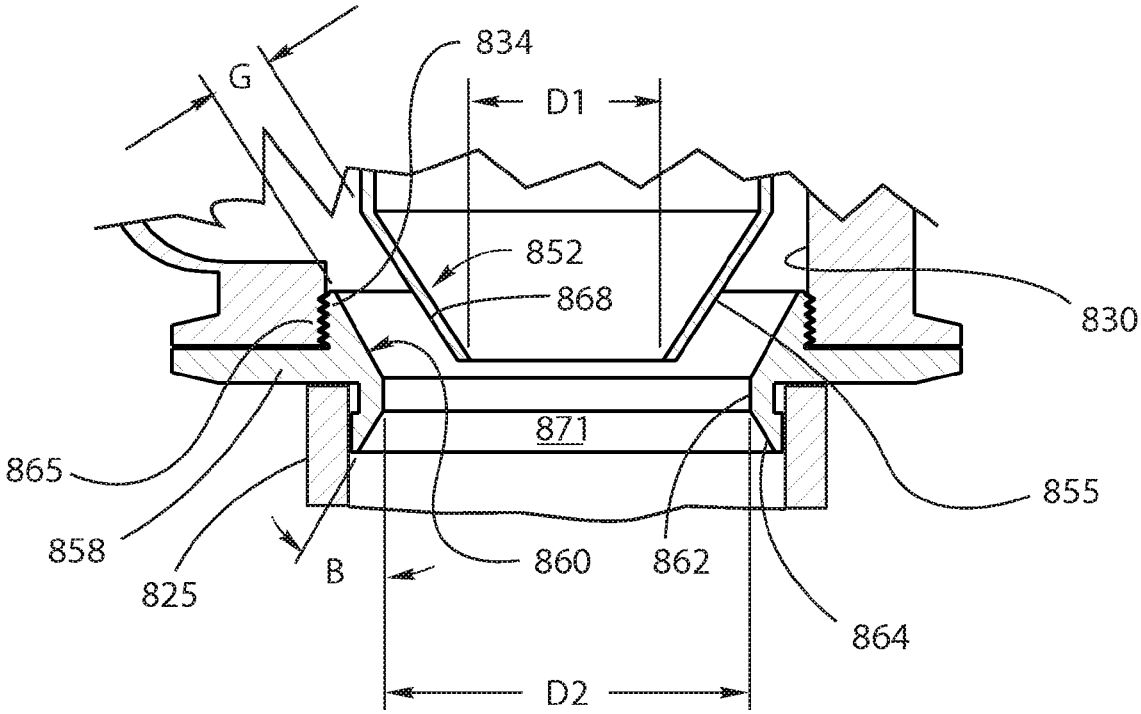
FIG. 10 depicts an enlarged sectional view of the radial pre-mixer.

For mixing and intermingling of the swirling liquid with the particulate material when the particulate material is discharged from the lower end of inner radial nozzle 852, a diffuser ring shown generally at 858 is mounted adjacent to the lower end of main body 828. Diffuser ring 858, as shown in FIG. 8, has an upper converging section defining an outer radial nozzle 860, a cylindrical throat 862, and a lower diverging section 864. An annular gap or constriction Gap "G" is formed between the concentric coaxial first and second radial nozzles 852 and 860.

The outer periphery of diffuser ring 858 has a main cylindrical body 828 of mixing device 810. Second and first radial nozzles 852 and 860 are coaxial and the inner peripheral surface 868 of first radial nozzle 860 is in concentric parallel relation to outer frusto-conical surface. 855 on second radial nozzle 852.

Thus, angle "A" can apply equally to nozzle 860. Gap "G" formed between coaxial nozzles 852 and 860 and coaxial concentric frusto-conical surfaces 855 and 868 can have a width of about ½ inch for an internal diameter D1 of about 2 inches for the discharge opening of nozzle 852 to provide a ratio of about 4:1 between diameter D1 and gap "G". A ratio between about 2:1 and about 8:1 between diameter D1 and gap "G" can function satisfactorily under various conditions. Gap "G" may be adjusted in width by providing a plurality of interchangeable diffuser rings 858 with different selected diameters D2 thereby to vary the velocity of the fluid passing through gap "G".

The width of gap "G" can also be varied by adjustments between threads 834 and 865. The width of annular gap "G" as shown in FIG. 8 is selected to provide a minimum velocity of about 60 feet per second for the relative volume of liquid pumped. Thus, the width of gap "G" is adjusted to provide a predetermined flow rate for the liquid.

Throat 862 has an inner cylindrical surface to define inner diameter D2 and extends downwardly a distance of about ½ inch. The length of throat 862 may vary between about ¼ inch and about 2 inches for a diameter D2. Diameter D2 of throat 862 is larger than diameter D1 and is preferably about 2½ inches for a diameter D1 of 2 inches. Diameter D2 may vary between about 1.2 times diameter D1 and 2.0 times diameter D1 for satisfactory results as determined by the flow rate. Lower diverging section 864 of diffuser ring 858 has an inner peripheral frusto-conical surface, which slopes at an angle B of about 30 degrees relative to the longitudinal axis of diffuser ring 858. Angle "B" between about 15 degrees and about 45 degrees can function adequately under various conditions. A mixing chamber 71 for the mixing and intermingling of the particulate material and liquid for forming a slurry.

The mixing is at a maximum adjacent the lower end of nozzle 852 and decreases as the mixture flows downwardly in conduit 825. A vacuum is exerted adjacent the lower end of nozzle 852 at mixing chamber 871 with a nozzle fluid velocity of about 160 feet per second and an operating pressure drop of 25 psig. The width of gap "G" is selected to provide a liquid between about 160 feet per second and about 120 feet per second dependent on characteristics or functions of the liquid, such as density, flow rate, and viscosity.

In operation, the diverted pressurized liquid, such as water, flows through rectangular opening 836 into annular vortex chamber 856 between particulate inlet tube 842 and the main body 828. The liquid moves along arcuate surface 841 and then along cylindrical surface 830 in a smooth transition with minimal turbulence for creating a swirling movement in a descending helical path of the liquid to gap "G" formed between nozzles 852 and 860.

The velocity of the swirling liquid increases as the swirling liquid moves downwardly along gap "G" and the parallel frusto-conical surfaces 855 and 868 which are positioned at a converging angle of about 30 degrees with respect to the longitudinal axis of the particulate tube 842. As the swirling liquid passes downwardly below the lower end of converging nozzle 852, a suction is created by the liquid to draw or suck the particulate material from particulate inner tube 842.

The swirling liquid passing through gap "G" at a relatively high-velocity and strong vortex is effective in obtaining a high interfacial contact with the particulate material as the particulate material passes downwardly from nozzle 852. A mixing chamber 871 for the liquid and the particulate material can be created adjacent the end of nozzle 852 and particularly in diffuser ring 858 for an intimate, continuous mixing action in a relatively short length of travel after the particulate material is discharged from the lower end of nozzle 852.

Gap "G" formed by coaxial concentric frusto-conical surfaces 855 and 868 can be of a uniform width or thickness between about ¼ inch to about 1 inch. Internal diameter D1 of nozzle 852 is between about three and eight times the width of gap "G". The frusto-conical surfaces 855 and 868 can extend at an angle A relative to the longitudinal axis of tube 842. The height of the vortex chamber 856 is relatively small and thereby provides a swirling motion of the liquid in a minimal time period.

The velocity of the liquid passing through diffuser ring 858 adjacent the lower end of nozzle 852 varies with the pressure of the liquid and increases in velocity with an increase in fluid pressure. For example, with the liquid having fluid pressure of about 25 psi, a velocity of about 61 feet per second is obtained. With a fluid pressure of about 40 psi, a velocity of about 75 feet per second is obtained.

The embodiments of the dust-free low pressure mixing system for use with drilling fluids provides an environmentally friendly mud mixing system by reducing the dust from dry components. The embodiments of the dust-free low pressure mixing system are capable of eliminating dust because the dry components are in a closed system from storage to mixing.

From the pre-mixer, a strong vortex is formed to dose the second dry component into the pressurized stream. That is, after mixing powered products through the hopper, the radial pre-mixer generates rotational energy that uniformly distributes particles in a thin sheet of liquid. A strong vortex develops that enhances molecular dispersion, promotes rapid polymer activation and fast clay hydration. It should be noted that the particle pre-wetting process eliminates the possibility of clumping, "fisheyes" and microgels.

Pressurized fluid enters the pre-wetting chamber of the radial pre-mixer tangentially and radiates outwardly to the wall of the mixing chamber. Powdered materials are introduced through a chemical hopper and are drawn in the eye of a strong vortex. As the particles are absorbed into the spinning fluid, the centrifugal force moves the mixture outward, providing separation between particles as the "wetting-out" or hydration process develops. The particle spreading caused by the centrifugal action completely eliminates adhesion or clumping associated with conventional mixing devices. Additionally, the centrifugal force will eliminate air entrainment in the slurry.

While these embodiments have been described with emphasis on the embodiments, it should be understood that within the scope of the appended claims, the embodiments might be practiced other than as specifically described herein.

What is claimed is:

1. A dust-free mixing system for use with drilling fluids, comprising:

an eductor having an eductor housing with an axial bore for receiving a first suction induction port for receiving a first dry component, a second suction induction port for receiving a second dry component, and a third suction induction port for receiving a third dry component, wherein the first dry component, second dry component, and third component are mixed with a pressurized liquid flowing through the axial bore within a high-velocity, low-pressure mixing region, creating an eductor discharge, wherein the eductor further comprises:

a nozzle with a non-circular axisymmetrical lobe shaped orifice disposed within the axial bore forming both an axial flow path and a radial flow path wherein the high-velocity, low-pressure mixing region is in communication with the nozzle;

a parabolic inlet in communication with the high-velocity, low-pressure mixing region and integrally connected to a cylindrical throat;

a conical diffuser integrally connected to the cylindrical throat; and wherein the eductor discharge is a uniform mixed blend and is discharged from the conical diffuser with a pressure recovery of at least 50 percent of the pressurized liquid;

a silo comprising a body with an inlet port, a discharge segment connected to the body, and a vent;

a flow promoter connected to the discharge segment, wherein the flow promoter comprises a flow promoter body with a cavity core, an inlet end, an outlet end, and a central axis, wherein the cavity core extends from the inlet end to the outlet end, the cavity core defining an outlet orifice at the outlet end, the inlet end comprising an inlet orifice and an inlet face, the cavity core and a plurality of lobes defining the inlet orifice and between the plurality of lobes are a plurality of inlet ridges a plurality of inlet slopes; recessed into a flange;

a connecting conduit having a sight glass disposed between the flow promoter and the eductor for viewing fluid flow;

a jet-ring adapter disposed between the connecting conduit and the eductor;

wherein the jet-ring adapter has a motive fluid inlet for receiving pressurized fluid from a pressurized fluid source, thereby allowing cleaning of the dust-free mixing system with a high velocity jet downstream and a low pressure upstream;

a radial pre-mixer disposed on a first suction side of the eductor between a first dry component source and the eductor for generating a vortex to pre-wet the first dry component;

a diverter manifold for flowing a portion of the pressurized liquid from the eductor to the radial pre-mixer;

a cyclone separator attached to the vent of the silo and in communication with the third suction induction port of the eductor; and a fluidizer disposed between the flow promoter and the second suction induction port of the eductor; wherein the fluidizer comprises:

a concentric reducer comprising:

an air supply port for receiving pressurized air and an interior concentric cavity;

a flexible fluidizer insert, for removable fitting within the interior concentric cavity further comprising:

a groove into an outer surface of the flexible fluidizer insert at an elevated position to the air supply port; and whereby the pressurized air flows to the groove and causes the flexible fluidizer insert to flutter, fluidizing the second dry component preventing clumping by the second dry component during mixing.

2. The dust-free mixing system of claim 1, wherein the first dry component source is a hopper connected to the first suction induction port.

3. The dust-free mixing system of claim 2, further comprising a table secured to the hopper for feeding the first dry component to the hopper.

4. The dust-free mixing system of claim 1, wherein the fluidizer insert is urethane and the fluidizer housing is urethane, carbon steel, or stainless steel.

5. The dust-free mixing system of claim 2, wherein a first flow valve is disposed between the hopper and the radial pre-mixer.

6. The dust-free mixing system of claim 1, wherein a second flow valve is disposed between the secondary suction of the eductor and the flow promoter.

7. The dust-free mixing system of claim 1, wherein a third flow valve is disposed between the low pressure mixing region and an outside supply in fluid communication with the third suction induction port.

8. The dust-free mixing system of claim 1, wherein the cyclone separator further comprises an outer housing, a discharge apex defining a circular central region, a laterally extending entrance opening with a cone shape, a cone shape chamber, a vortex finder suspended from an upper inner housing and extending cone shape chamber for a substantial distance and a stabilizer, and wherein the vortex finder comprises a fluted inlet, and an outlet for clean air discharge.

9. The dust-free mixing system of claim 1, wherein the first dry component source is a hopper comprising a bowl shaped inner cavity, wherein a bag slitter insert is disposed within the bowl shaped inner cavity, and wherein the bowl shaped inner cavity is in fluid communication with the eductor allowing the first dry component to be fed to the eductor.

10. The dust-free mixing system of claim 9, wherein the bag slitter comprises a substantially hollow central cavity in fluid communication with the eductor allowing the first dry component to be fed to the eductor in a substantially dust-free manner.

11. The dust-free mixing system of claim 1, wherein the radial pre-mixer is an annular pump.

12. The dust-free mixing system of claim 1, wherein the eductor, silo, flow promoter, connecting conduit, radial pre-mixer, diverter manifold, cyclone separator, and fluidizer form an integrated connected closed system.

* * * * *